US010480111B2

(12) United States Patent
Song et al.

(10) Patent No.: US 10,480,111 B2
(45) Date of Patent: Nov. 19, 2019

(54) WASHING MACHINE

(71) Applicants: SAMSUNG ELECTRONICS CO., LTD., Suwon-si, Gyeonggi-do (KR); SNU R&DB FOUNDATION, Seoul (KR)

(72) Inventors: Myung-Seob Song, Hwaseong-si (KR); Dae Wook Park, Hwaseong-si (KR); Soon Cheol Kweon, Seoul (KR); Seung Kyung Park, Yongin-si (KR); Ho-Young Kim, Seoul (KR); Tae-Hong Kim, Seoul (KR); Junhee Choi, Yongin-si (KR)

(73) Assignees: SAMSUNG ELECTRONICS CO., LTD., Suwon-si (KR); SNU R&DB FOUNDATION, Seoul (KR)

( * ) Notice: Subject to any disclaimer, the term of this patent is extended or adjusted under 35 U.S.C. 154(b) by 209 days.

(21) Appl. No.: 14/594,435

(22) Filed: Jan. 12, 2015

(65) Prior Publication Data

US 2015/0204001 A1 Jul. 23, 2015

(30) Foreign Application Priority Data

Jan. 22, 2014 (KR) ..... 10-2014-0008038

(51) Int. Cl.

| | |
|---|---|
| ***D06F 19/00*** | (2006.01) |
| ***D06F 35/00*** | (2006.01) |
| *D06F 17/10* | (2006.01) |
| *D06F 37/26* | (2006.01) |

(52) U.S. Cl.

CPC ..... *D06F 19/00* (2013.01); *D06F 35/002* (2013.01); *D06F 17/10* (2013.01); *D06F 37/266* (2013.01)

(58) Field of Classification Search

CPC ..... D06F 35/002; D06F 19/00; B08B 3/102
USPC ..... 68/3 SS
See application file for complete search history.

(56) References Cited

U.S. PATENT DOCUMENTS

| | | | | |
|---|---|---|---|---|
| 1,838,595 | A * | 12/1931 | Turner | D06F 13/04 366/332 |
| 2,446,750 | A * | 8/1948 | Ferris | D06F 13/04 222/409 |
| 3,087,776 | A * | 4/1963 | Anderson | D06F 13/00 68/154 |
| 4,727,734 | A | 3/1988 | Kanazawa et al. | |
| 5,307,649 | A | 5/1994 | Lim et al. | |

(Continued)

FOREIGN PATENT DOCUMENTS

| | | |
|---|---|---|
| CN | 87102092 | 7/1988 |
| CN | 1473980 | 2/2004 |

(Continued)

OTHER PUBLICATIONS

Machine translation of CN 1750783 A, dated Mar. 2006.*

(Continued)

*Primary Examiner* — Joseph L. Perrin
*Assistant Examiner* — Kevin G Lee
(74) *Attorney, Agent, or Firm* — Staas & Halsey LLP

(57) ABSTRACT

A washing machine includes a tub; a drum rotatably disposed inside the tub; and an ultrasound generator configured to emit ultrasonic waves to washing water loaded in the drum, and to generate bubbles. The ultrasound generator applies ultrasonic energy to the washing water to cause chaotic oscillation of the bubbles.

17 Claims, 23 Drawing Sheets

(56) References Cited

U.S. PATENT DOCUMENTS

| | | | | |
|---|---|---|---|---|
| 5,432,969 | A | 7/1995 | Oh | |
| 5,862,684 | A * | 1/1999 | Park | D06F 13/06 15/37 |
| 6,497,140 | B1 * | 12/2002 | Zeqiri | G01H 11/08 73/19.03 |
| 7,004,182 | B2 * | 2/2006 | Duval | A47L 13/10 134/113 |
| 7,876,030 | B2 * | 1/2011 | Taki | A61B 17/32006 310/323.12 |
| 2004/0159127 | A1 * | 8/2004 | Woo | D06F 39/007 68/13 A |
| 2005/0252538 | A1 * | 11/2005 | Vernon | B82Y 30/00 134/94.1 |
| 2011/0135534 | A1 * | 6/2011 | Bates | A47L 15/0002 422/20 |
| 2013/0233030 | A1 * | 9/2013 | Chindyasov | D06F 19/00 68/3 SS |
| 2013/0255326 | A1 | 10/2013 | Im et al. | |
| 2015/0059415 | A1 * | 3/2015 | Greinnan | D06F 17/06 68/131 |

FOREIGN PATENT DOCUMENTS

| | | | | |
|---|---|---|---|---|
| CN | 1508321 | | 6/2004 | |
| CN | 1750783 | A * | 3/2006 | |
| CN | 1814893 | | 8/2006 | |
| CN | 1814893 | A * | 8/2006 | |
| CN | 201058323 | | 5/2008 | |
| CN | 102076435 | | 5/2011 | |
| EP | 0 288 378 | A1 | 10/1988 | |
| EP | 0392586 | A1 * | 10/1990 | D06F 19/00 |
| EP | 1 138 818 | | 10/2001 | |
| EP | 1 550 755 | A1 | 7/2005 | |
| EP | 2 443 981 | A2 | 4/2012 | |
| JP | 2003-311077 | | 11/2003 | |
| KR | 19980046482 | A * | 9/1998 | |
| KR | 10-0195444 | | 6/1999 | |
| WO | 2015/097634 | | 7/2015 | |
| WO | WO 2015/097634 | A1 | 7/2015 | |

OTHER PUBLICATIONS

Werner Lauterborn and Thomas Kurz, Physics of bubble oscillations, 2010 Rep. Prog. Phys. 73 106501.*

Machine translation of CN 1814893 A, dated Aug. 2006. (Year: 2006).*

Machine translation of KR 19980046482 A, dated Sep. 1998. (Year: 1998).*

European Search Report dated Mar. 26, 2015 in corresponding European Patent Application No. PCT/KR2015/000628.

European Search Report dated Oct. 7, 2015 in corresponding European Patent Application No. 15151848.7.

Chinese Office Action dated Feb. 23, 2018 in Chinese Patent Application No. 201510033104.7.

Chinese Office Action dated Oct. 24, 2018 in Chinese Patent Application No. 201510033104.7.

Chinese Office Action dated Apr. 2, 2019 in Chinese Patent Application No. 2015100331047.

* cited by examiner

| | TRANSDUCER | TRANSDUCER + HORN | | |
|---|---|---|---|---|
| | | STEP SHAPE | EXPONENTIAL SHAPE | CONICAL SHAPE |
| SHAPE |  |  |  |  |
| DISPLACEMENT [um] IN AIR | 12.1 | 60.94 | 31.24 | 16.39 |
| DISPLACEMENT [um] IN WATER | 0.77 | 2.42 | 3.41 | 4.73 |
| RESULTS OF ANALYSIS |  |  |  |  |

(a) Volume oscillation (b) Chaotic oscillation (a)

(b)

WASHING MACHINE

CROSS-REFERENCE TO RELATED APPLICATIONS

This application claims the benefit of Korean Patent Application No. 10-2014-0008038, filed on Jan. 22, 2014 in the Korean Intellectual Property Office, the disclosure of which is incorporated herein by reference.

BACKGROUND

1. Field

Embodiments of the present disclosure relate to a washing machine.

2. Description of the Related Art

Ultrasonic energy has been used in various technical fields. Recently, studies into a technique for applying ultrasonic energy to a washing machine are actively conducted.

Acoustic radiation pressure among the characteristic factors of ultrasonic energy oscillates a medium together with ultrasonic oscillation when acoustic intensity exceeds an amplitude of a specific threshold value. Accordingly, if the acoustic radiation pressure is used to wash clothes or textile goods, it can be able to facilitate elimination of foreign materials, stains, and microorganisms adhered between or absorbed on fiber texture. A straight jet, which is the flow of fluid going straight when ultrasonic oscillation occurs, can facilitate various reactions, such as ultrasonic cleaning and ultrasonic dispersion. A standing wave is an acoustic wave in which an incident wave and a reflected wave do not overlap when a plane acoustic wave is incident at a right angle to the boundary of a wide wall. If resonance occurs due to frequency overlapping, a maximum amplitude appears, whereas if the amplitude becomes zero, maximum pressure appears, which results in tissue destruction of foreign materials, stains, and microorganisms existing in an area to which ultrasonic waves are strongly applied. Directivity of ultrasonic waves is a characteristic in which sound is strongly emitted in a specific direction according to the pitch of frequency so that high-pitched sound having a high frequency is emitted intensively in the front direction of a plane of vibration, and low-pitched sound having a low frequency is emitted in the traverse direction of a plane of vibration as well as in the front direction of the plane. The sharper directivity appears at the higher frequency. Directivities of sound sources having different magnitudes become more sharp at the greater ratios of the magnitudes of the sound sources with respect to the diameters or wavelengths of the sound sources, so that cell tissues of foreign materials, stains, and microorganisms existing within the range of directivity can be destructed.

Ultrasonic Cavitation is a phenomenon in which when ultrasonic waves greatly accelerate medium particles, cavitation nuclei existing in fluid are collected, grown, developed, and finally squeezed. Since fluid includes gases depending on the kind, temperature, and pressure of the fluid, cavities or air bubbles are grown in proportion to the sizes of atoms or molecules when ultrasonic waves are applied to the fluid.

Based on the above-described principle, if an oscillator for low-frequency oscillation is installed in a drum to cause resonance, it will be possible to perform washing through a chemical action of detergents and mechanical energy caused by cavitation or nonlinear oscillation of generated bubbles.

SUMMARY

Therefore, it is an aspect of the present disclosure to provide a washing machine capable of improving an effect of washing by causing chaotic oscillation of bubbles through ultrasonic energy.

Additional aspects of the disclosure will be set forth in part in the description which follows and, in part, will be apparent from the description, or may be learned by practice of the disclosure.

In accordance with one aspect of the present disclosure, a washing machine includes: a tub; a drum rotatably disposed inside the tub; and an ultrasound generator configured to emit ultrasonic waves to washing water loaded in the drum, and to generate bubbles, wherein the ultrasound generator applies ultrasonic energy to the washing water to cause chaotic oscillation of the bubbles.

A condition of the ultrasonic energy causing the chaotic oscillation of the bubbles may include at least one condition of a displacement amplitude condition of the bubbles and an ultrasonic wave frequency and acoustic pressure condition.

A displacement amplitude of the ultrasonic waves that are generated by the ultrasound generator may be in a range of 4.5 μm to 22.5 μm in the washing water.

If a frequency generated by the ultrasound generator is 20 kHz, acoustic pressure of the ultrasonic waves may be in a range of 600 kPa to 3000 kPa.

The ultrasound generator may include an ultrasound transducer configured to generate ultrasonic waves, and an ultrasound horn coupled with the ultrasound transducer and configured to guide the ultrasonic waves generated by the ultrasound transducer to the outside.

The washing machine may further include a pulsator disposed in the drum and configured to generate streams of water, wherein the ultrasound generator is coupled with an upper part of the pulsator.

The washing machine may further include an agitator disposed in the drum and configured to rotate, wherein the ultrasound generator is coupled with an upper part of the agitator.

The washing machine may further include a door disposed to cover an opening of the tub, wherein the ultrasound generator is coupled with an inner side of the door.

The washing machine may further include: a pulsator disposed in the drum and configured to generate streams of water; and a door disposed to cover an opening of the tub, wherein if a plurality of ultrasound generators are provided, the plurality of ultrasound generators are respectively coupled with an upper part of the pulsator and an inner side of the door.

The washing machine may further include: an agitator disposed in the drum and configured to rotate; and a door disposed to cover an opening of the tub, wherein if a plurality of ultrasound generators are provided, the ultrasound generators are respectively coupled with an upper part of the agitator and an inner side of the door.

The washing machine may further include: a door; and a diaphragm configured to seal between the tub and the door, wherein the ultrasound generator is coupled with the diaphragm so as to contact washing water loaded in the drum.

The washing machine may further include: a door; a diaphragm configured to seal between the tub and the door; and a nozzle configured to jet water into the drum, wherein one end of the ultrasound generator is coupled with one end of the nozzle so as to apply acoustic pressure of ultrasonic waves to water jetted into the drum.

The other end of the ultrasound generator may be coupled with the diaphragm.

The drum may include one or more through-holes, and the ultrasound generator may be disposed between the tub and the drum, and transfer ultrasonic waves into the drum through the through-holes.

The tub may further include a support unit having a shape configured to support the ultrasound generator, and configured to adjust an incident angle of ultrasonic waves that are generated by the ultrasound generator.

The ultrasound generator may include an ultrasound transducer configured to generate ultrasonic waves, and an ultrasound horn coupled with the ultrasound transducer and configured to guide the ultrasonic waves generated by the ultrasound transducer to the outside, the ultrasound horn may include a first element coupled with the ultrasonic transducer, and a second element connected to the first element, and a diameter of the first element may be longer than a diameter of the second element.

A diameter ratio of the first element and the second element may be 2:1

A length ratio of the first element and the second element in an emission direction of ultrasonic waves may be 35:27.

A longitudinal section of the ultrasound horn may have a step shape.

The second element of the ultrasound horn may have an inwardly concave shape.

The second element of the ultrasound horn may have a conical shape.

BRIEF DESCRIPTION OF THE DRAWINGS

These and/or other aspects of the disclosure will become apparent and more readily appreciated from the following description of the embodiments, taken in conjunction with the accompanying drawings of which:

FIGS. 11A, 11B, and 110 are views for describing an ultrasound generator according to another embodiment of the present disclosure;

DETAILED DESCRIPTION

Figure 1:
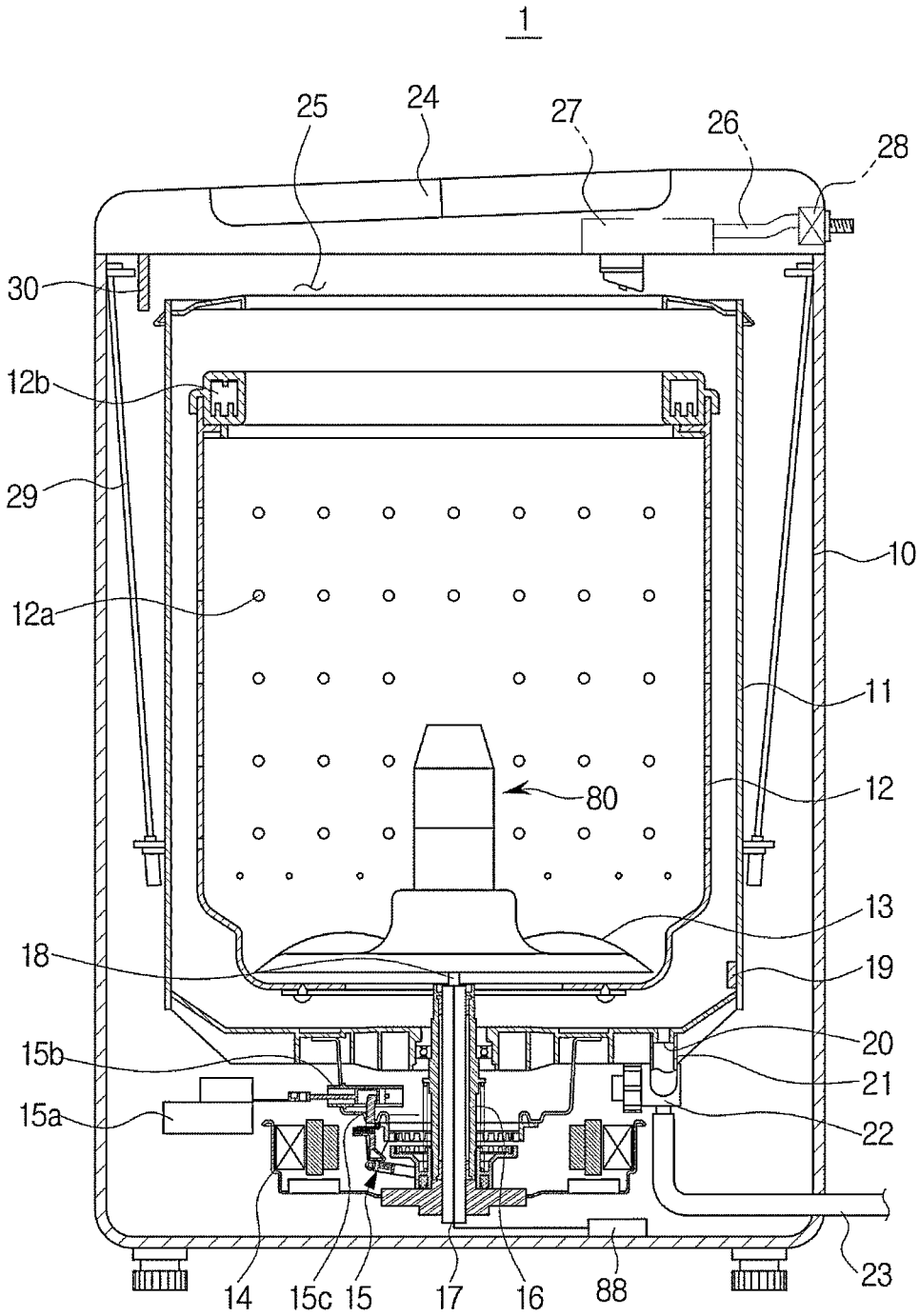
FIG. 1 is a cross-sectional view illustrating a configuration of a washing machine according to an embodiment of the present disclosure.

Reference will now be made in detail to the embodiments of the present disclosure, examples of which are illustrated in the accompanying drawings, wherein like reference numerals refer to like elements throughout. In the following description, if it is determined that detailed descriptions for related art make the subject matter of the present disclosure obscure unnecessarily, the detailed descriptions will be omitted. In this specification, the terms "first" and "second", as applied to detectable species, are used for the purposes of identification and do not imply any order of detection.

Hereinafter, embodiments of the present disclosure will be described in detail with reference to the appended drawings.

FIG. 1 is a cross-sectional view illustrating a configuration of a washing machine according to an embodiment of the present disclosure.

Referring to FIG. 1, a washing machine 1 may include a cabinet 10 having a box shape and constituting an external appearance of the washing machine 1, a tub 11 disposed inside the cabinet 10 and configured to load water (washing water or rinsing water) therein, a drum 12 rotatably disposed inside the tub 11 and configured to load laundry therein, a pulsator 13 rotatably installed inside the drum 12 and configured to rotate in a left or right direction (forwardly or backwardly) to generate streams of water, and an ultrasound generator 80 configured to generate ultrasonic energy. Also, the washing machine 1 may have a vertical shaft.

The drum 12 has a cylindrical shape wherein the top part opens, and a plurality of through-holes 12*a* are formed around the drum 12. A balancer 12*b* may be provided in the upper part of the drum 12 so that the drum 12 can stably rotate upon high-speed rotation.

Below the tub 11, a washing motor 14 to generate a driving force for rotating the drum 12 and the pulsator 13, and a power switching device 15 to transfer the driving force generated by the washing motor 14 to both or one of the drum 12 and the pulsator 13 may be provided.

The drum 12 may be connected to a hollow dehydrating shaft 16, and the washing shaft 17 installed in the cavity of the dehydrating shaft 16 may be connected to the pulsator 13 through a washing shaft connecting element 18.

The washing motor 14 may be a Direct Drive (DD) type motor having a variable speed function. The washing motor 14 may transfer a driving force to the drum 12 or the pulsator 13 according to rising/falling of the power switching device 15.

The washing motor 14 may be a universal motor composed of a field coil and an armature, or a Brush Less Direct Current (BLDC) motor composed of a stator and a rotor. However, the washing motor 14 may be any other motor as long as it can be applied to the washing machine 1. Also, the washing motor 14 may be a belt type.

The power switching device 15 may include an actuator 15*a* to generate a driving force for switching power, a rod element 15*b* to move linearly according to an operation of the actuator 15*a*, and a clutch element 15*c* connected to the rod element 15*b* and configured to rotate according to a movement of the rod element 15*b*.

The washing motor 14 may perform wetting cloth, dissolving detergents, washing, dipping and rising, and untangling cloth by rotating the washing shaft 17 forward or backward when coupling between the washing shaft 17 and the dehydrating shaft 16 is released to thus move the pulsator 13 in left and right directions.

Also, the washing motor 14 may rotate the washing shaft 17 and the dehydrating shaft 16 forward or backward when the washing shaft 17 is coupled with the dehydrating shaft 16 so as to rotate both the pulsator 13 and the drum 12 in the same direction, thereby performing a shower-rinsing process and a dehydrating process.

A water level sensor 19 for detecting a frequency changing according to a level of water to determine an amount (level) of water loaded in the tub 11 may be installed on the lower inner surface of the tub 11.

A drain 20 to discharge water loaded in the tub 11 to the outside may be formed in the bottom of the tub 11, and the drain 20 may be connected to a first drainpipe 21. A drain motor 22 to control drainage may be installed in the first drainpipe 21, and an outlet of the drain motor 22 may be connected to a second drainpipe 23 to discharge water to the outside.

In the upper part of the cabinet 10, a door 24 for opening or closing the washing machine 1 in order to put laundry into the drum 12 or to take laundry out of the drum 12 may be mounted.

In the upper part of the tub 11, an opening 25 to put laundry into the drum 12 or to take laundry out of the drum 12 may be formed, and the opening 25 may be opened or closed by the door 24.

Also, a water-supply pipe 26 to supply water to the tub 11 may be installed in the upper part of the cabinet 10. One end of the water-supply pipe 26 may be connected to an external water-supply source, and the other end of the water-supply pipe 26 may be connected to a detergent supply unit 27. Water supplied through the water-supply pipe 26 may be supplied to the tub 11 together with detergents via the detergent supply unit 27. The water-supply pipe 26 may include a water-supply valve 28 to control supply of water.

Meanwhile, the tub 11 may be supported by a suspension system 29 with respect to the cabinet 10, and a checker switch 30 to detect shaking that occurs when a user touches the drum 12 in order to take laundry out of the drum 12 may be installed between the tub 11 and the cabinet 10. In addition, when the drum 12 rotates eccentrically due to an unbalanced load of laundry, the checker switch 30 may detect excessive vibration of the tub 11 when the tub 11 hits the checker switch 30 before hitting the cabinet 10.

The ultrasound generator 80 may emit ultrasonic waves to washing water loaded in the drum 12 to generate bubbles, and may operate according to a voltage applied from a power supply unit 88. The power supply unit 88 may be configured as a separate power supply dedicated for the ultrasound generator 80, or the power supply unit 88 may be integrated into a power supply unit to apply a voltage to the washing machine 1. The ultrasound generator 80 may apply ultrasonic energy to the washing water so as to cause chaotic oscillation of bubbles. Acoustic pressure of the ultrasonic waves may depend on a displacement amplitude of the ultrasound generator 80. In other words, an ultrasonic wave condition to cause chaotic oscillation of bubbles may include at least one condition of a displacement amplitude condition of ultrasonic waves and an ultrasonic wave frequency and acoustic pressure condition. This will be described later.

Figure 2:
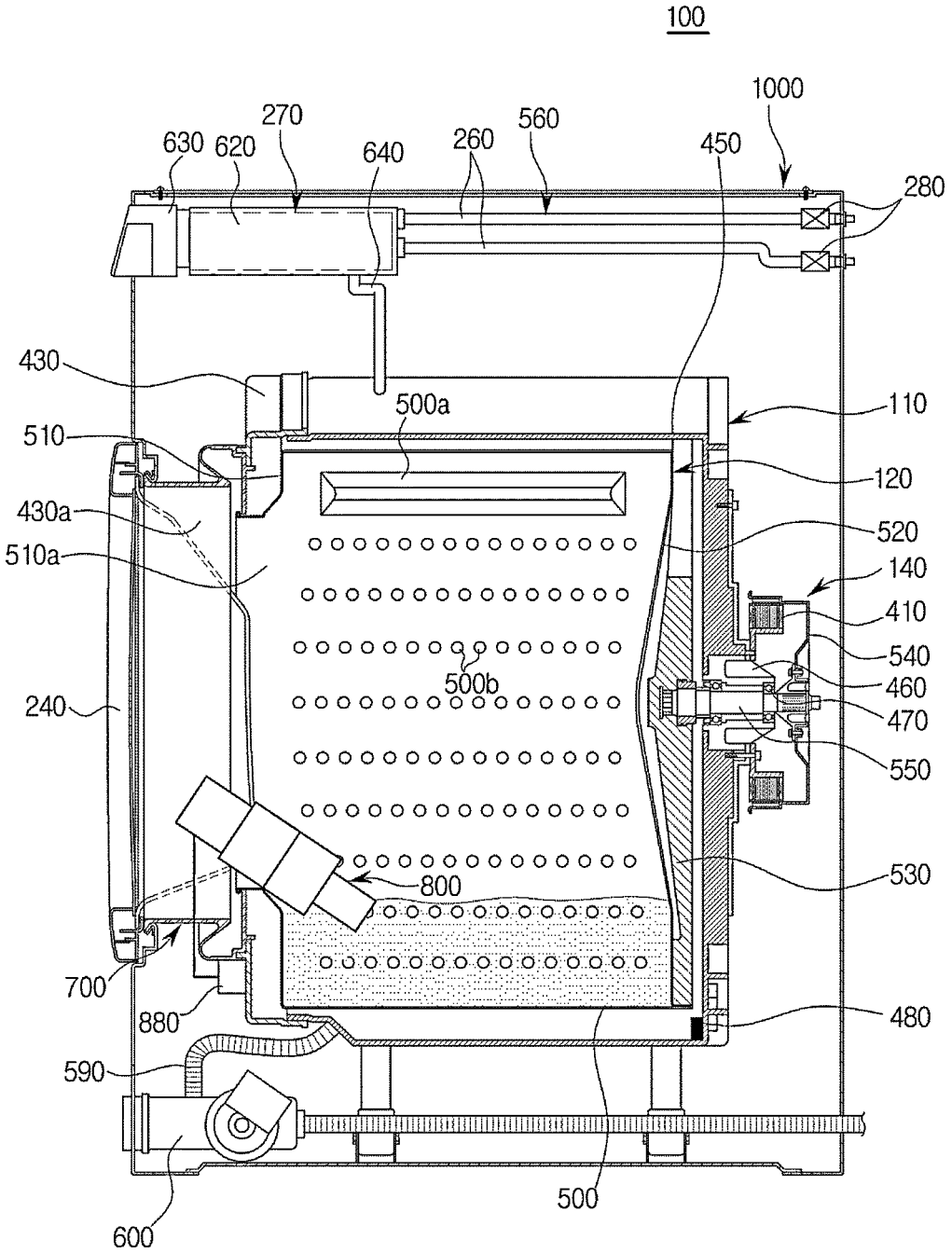
FIG. 2 is a cross-sectional view illustrating a configuration of a washing machine according to another embodiment of the present disclosure.

FIG. 2 is a cross-sectional view illustrating a configuration of a washing machine according to another embodiment of the present disclosure. The washing machine is a drum-type washing machine.

Referring to FIG. 2, a washing machine 100 may include a cabinet 1000 constituting an external appearance of the washing machine 100, a tub 110 to load water therein, a drum 120 rotatably disposed inside the tub 110 and configured to load laundry therein, a driving motor 140 to rotate the drum 120, a water-supply unit 560 to supply water to the tub 110, a drain 600 to discharge water loaded in the tub 110, a detergent supply unit 270 to supply detergents, a dryer unit (not shown) to dry laundry loaded in the drum 120, and an ultrasound generator 800.

In the front, center part of the cabinet 10, a laundry hole to put laundry into the drum 120 or to take laundry out of the drum 120 may be formed, and a door 240 to open and close the laundry hole may be provided to cover the laundry hole. The door 240 may be connected to the cabinet 1000 rotatably by a hinge, and if the laundry hole is closed, the door 240 does not easily open due to a hook.

The tub 110 may be provided inside the cabinet 1000, and include a rear tub member 450 having a cylindrical shape, wherein the rear part of the rear tub member 450 is closed, and a front tub member 430 located ahead of the rear tub member 450. In the rear part of the rear tub member 450, a bearing 470 to rotatably fix the driving motor 140, and a bearing housing 460 may be provided. In the front part of the front tub member 430, an opening **430*a* to put laundry into the drum 120 or to take laundry out of the drum 120** may be formed.

A tub temperature sensor 480 to detect the inside temperature of the tub 110 may be installed inside the tub 110, and the tub temperature sensor 480 may be a thermistor in which electrical resistance changes depending on a temperature.

Also, the tub 110 may be connected to water supply pipes 260 and the detergent supply unit 270 via a link pipe 640 provided above the tub 110, and the tub 110 may be connected to a drain (not shown) via a drain pipe 590 provided below the tub 110.

The drum 120 may be rotatably positioned inside the tub 110. The drum 120 may include a drum body 500 having a cylindrical shape, a drum front plate 510 provided at the front of the drum body 500, and a drum rear plate 520 provided at the back of the drum body 500.

A plurality of through-holes **500*b* to make water loaded in the tub 110 flow into the drum 120 may be formed around the drum body 500, and a lifter 500*a* to lift laundry may be provided on the inner surface of the drum body 500. An opening 510*a* to put laundry into the drum 120 or to take laundry out of the drum 120 may be formed in the drum front plate 510, and a flange 530 to which the driving motor 140 to rotate the drum 120 is connected may be mounted on the drum rear plate 520**.

The driving motor 140 may include a stator 410 fixed on the rear part of the tub 110, a rotor 540 rotating by magnetically interacting with the stator 410, a rotating shaft 550 wherein one end is connected to the rotor 540, and the other end penetrates the rear part of the tub 110 to be connected to the flange 530 mounted on the rear part of the drum 120, and a hole sensor (not shown) to detect a rotation displacement of the rotor 540. Also, the rotating shaft 550 may be rotatably fixed on the tub 110 by the bearing 470 and the bearing housing 460 installed in the rear part of the tub 110. The driving motor 140 may be a BrushLess Direct Current (BLDC) motor or a Alternating Current (AC) motor that can easily control a rotation velocity.

The water supply unit 560 may be provided over the tub 110, and may include the water supply pipes 260 to connect the detergent supply unit 270 to an external water supply source (not shown), and water supply valves 280 disposed one of the ends of the water supply pipes 260 to open or close the water supply pipes 260. The water supply valves 280 may be solenoid valves to open or close the water supply pipes 260 according to an electrical signal.

The detergent supply unit 270 may be provided over the tub 110, and connected to the tub 110 via the link pipe 640. The detergent supply unit 270 may include a detergent case 620 to contain washing detergents and rinsing detergents therein, and a detergent case housing 630 to accommodate the detergent case 620 therein.

The ultrasound generator 800 may be coupled with a diaphragm 700 to seal between the tub 110 and the door 240. The ultrasound generator 800 may emit ultrasonic waves to washing water loaded in the drum 120 to generate bubbles. The ultrasound generator 800 may operate according to a voltage applied from a power supply unit 880. The ultrasound generator 800 may penetrate the diaphragm 700 so as to face the inside of the drum 120. However, coupling between the ultrasound generator 800 and the diaphragm 700 is not limited to this. The ultrasound generator 800 may be connected to the surface of the diaphragm 700 through fixing elements such as bolts, or through an adhesive such as glue. Also, the ultrasound generator 800 may be disposed at any location as long as it can emit ultrasonic waves to washing water, although the ultrasound generator 800 is not coupled with the diaphragm 700.

The ultrasound generator 800 may apply ultrasonic energy to washing water so as to cause chaotic oscillation of bubbles. The ultrasonic energy may depend on a displacement amplitude of the ultrasound generator 800, a frequency, and acoustic pressure.

Meanwhile, in order to wash fabrics, it is necessary to appropriately control characteristic factors of ultrasonic energy. Particularly, a configuration for controlling the frequency, acoustic pressure, and displacement amplitude of ultrasonic waves is needed. A principle of washing by ultrasonic waves is based on four factors: acoustic streaming in which streams of fluid are made by acoustic energy; acoustic pressure gradient which is power generated due to changes in pressure by an ultrasound oscillator; dynamic pressure representing a pressure distribution by contraction/expansion of bubbles; and interface sweeping which is a torque generated when the interfaces of bubbles contact contamination particles. The dynamic pressure caused by contraction/expansion of bubbles, among the four factors, generates greatest power (energy), and the power reaches 1 GPa.

Figure 15:
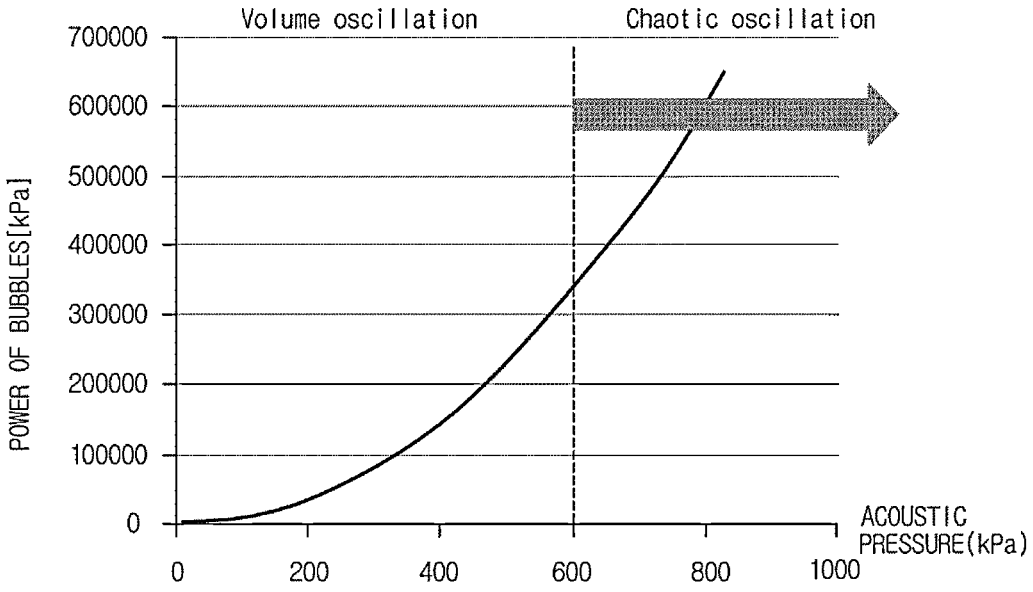
FIGS. 15 to 17 are views for describing the principle of ultrasonic waves that are applied to an embodiment of the present disclosure.
Figure 19:
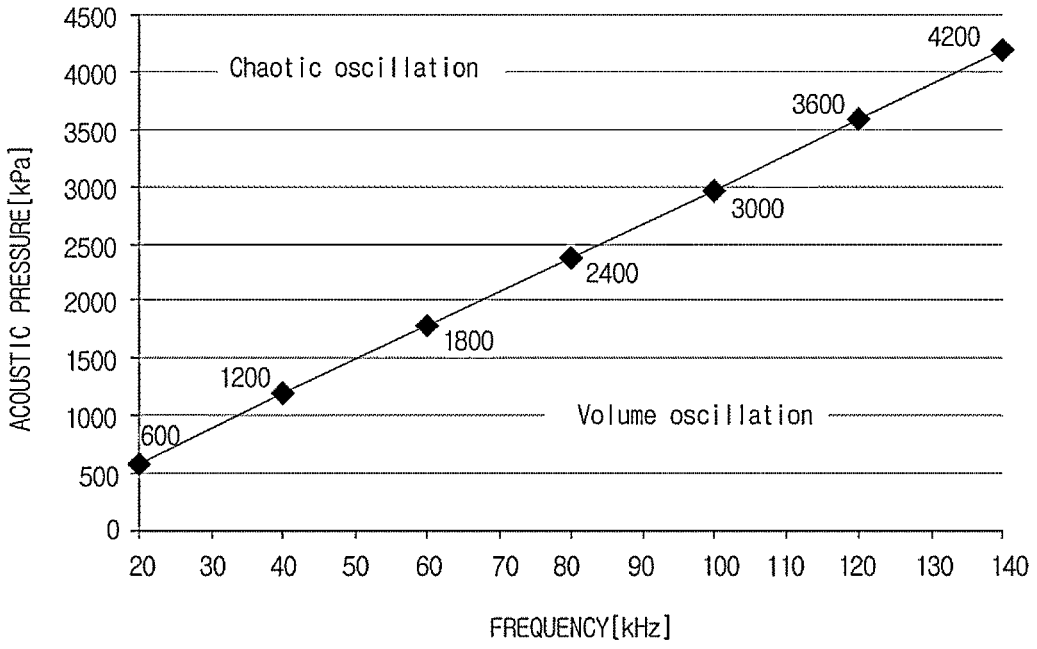

FIG. 15 is a graph showing a relationship between acoustic pressure that is generated by ultrasonic waves and power that is generated by bubbles. As shown in FIG. 15, power that is generated by bubbles increases exponentially as acoustic pressure increases, under a frequency condition of 20 kHz. If acoustic pressure that is generated by ultrasonic waves is below a specific magnitude, volume oscillation of bubbles occurs, and if acoustic pressure that is generated by ultrasonic waves is equal to or greater than the specific magnitude, chaotic oscillation of bubbles occurs. At the frequency of 20 kHz as shown in FIG. 15, the specific magnitude of acoustic pressure may be 600 kPa. If the frequency of ultrasonic waves changes, acoustic pressure that causes chaotic oscillation of bubbles may change accordingly. As shown in FIG. 19, acoustic pressure that causes chaotic oscillation of bubbles may increase linearly as the frequency of ultrasonic waves increases.

Figure 16:
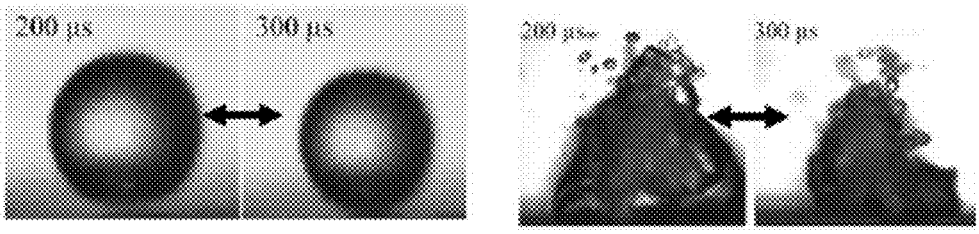

FIG. 16, parts (a) and (b) shows bubbles photographed by a high-speed camera, wherein 200 μs and 300 μs mean times.

As shown in FIG. 16, part (a), in volume oscillation of a bubble, the diameter of the bubble changes while the shape of the bubble is maintained, when the time elapses from 200 μs to 300 μs. As shown in FIG. 16, part (b), in chaotic oscillation of a bubble, the bubble is destructed so that the size and location of the bubble all change, when the time elapses from 200 μs to 300 μs. Typical ultrasonic washing that has been applied to glass lens cleaners, semiconductor cleaning, etc. uses volume oscillation of bubbles. However, power that is generated by volume oscillation of bubbles may be insufficient to wash laundry such as soiled test fabrics (for example, Carbon Black) requiring great mechanical power.

Figure 17:
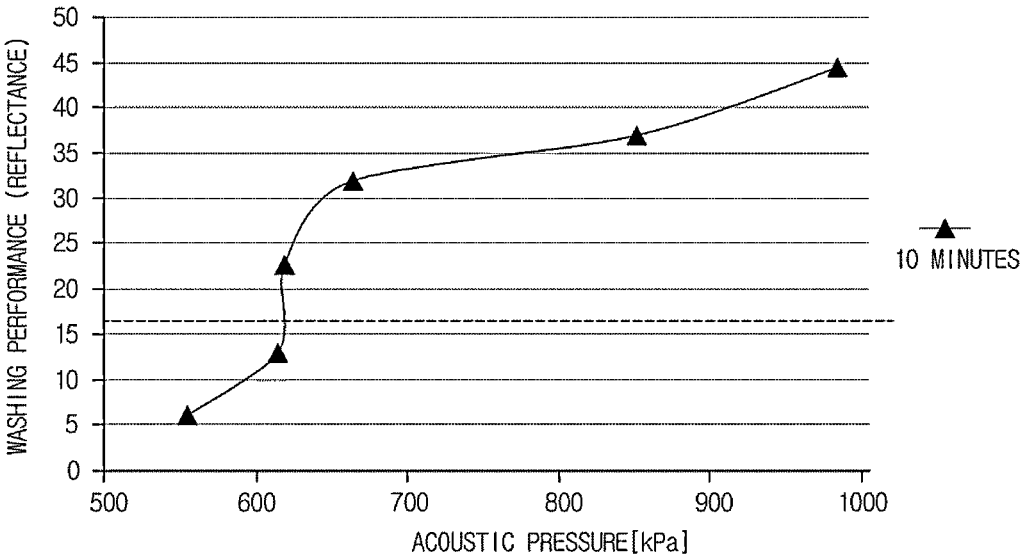
Figure 17:
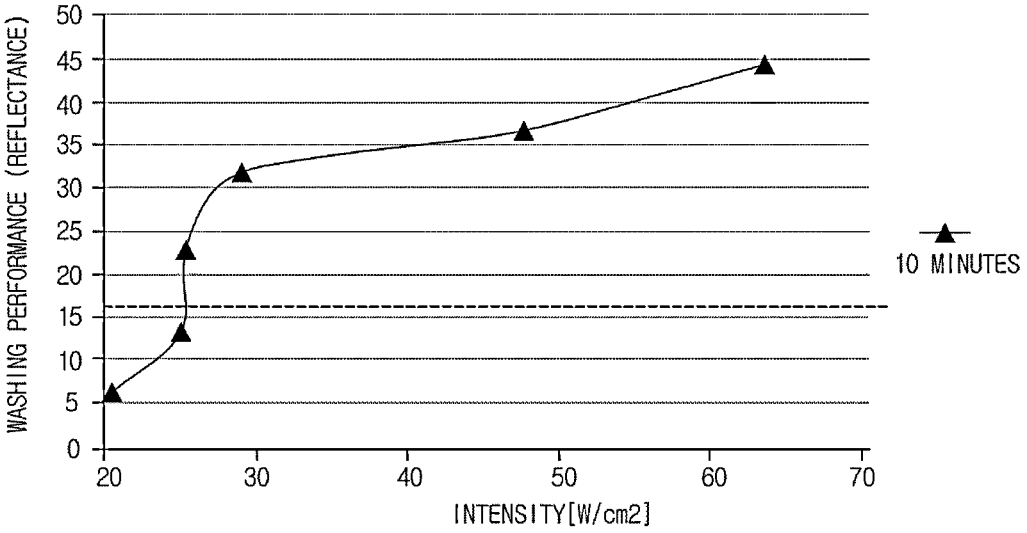

FIG. 17, parts (a) and (b), shows the washing performance (reflectance) of soiled test fabrics Carbon Black with respect to acoustic pressure (FIG. 17, part (a)) and with respect to intensity (FIG. 17B), when a washing process is performed for 10 minutes by generating ultrasonic waves under a frequency condition of 20 kHz. As shown in FIG. 17, parts (a) and (b), in order to wash Carbon Black requiring greatest mechanical power among soiled fabrics, acoustic pressure of at least 600 kPa and intensity of at least 25 $W/cm^2$ are required, under the frequency condition of 20 kHz.

That is, in order to show good washing performance (exceeding a washing performance reference value corresponding to dotted lines of FIG. 17, parts (a) and (b), with respect to Carbon Black, acoustic pressure has to reach at least 600 kPa so that chaotic oscillation of bubbles occurs. For example, as shown in FIG. 17, part (a), a graph on which triangle nodes are denoted shows that washing performance is improved sharply from acoustic pressure of about 600 kPa. A graph of FIG. 17, part (b), on which triangle nodes are denoted shows intensities matching acoustic pressure values of FIG. 17, part (a).

Figure 18:
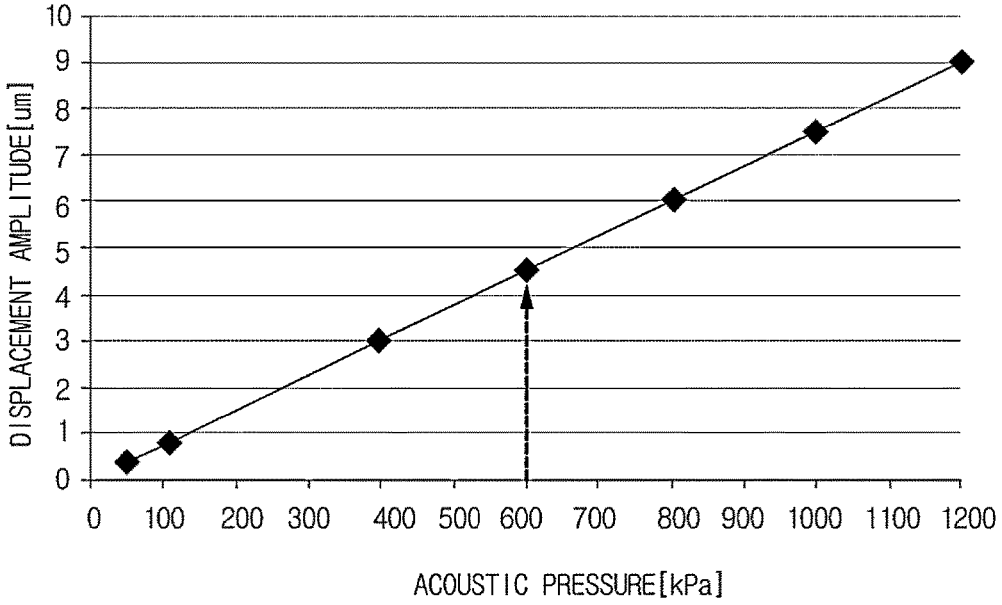
FIGS. 18 to 20 are views for describing a driving principle of a washing machine.

Acoustic pressure of ultrasonic waves may be adjusted by controlling the displacement amplitude of the ultrasound generator 80 (see FIG. 1 or 2). A relationship between acoustic pressure and displacement amplitude is shown in FIG. 18. As shown in FIG. 18, in order to make acoustic pressure reach 600 kPa, a displacement amplitude has to be 4.5 μm. The relationship between acoustic pressure and displacement amplitude as shown in FIG. 18 can be expressed as Equation (1), below.

$$S_{max} = \frac{P_{max}}{\rho c \omega} = \frac{P_{max}}{\rho c 2\pi f}, \tag{1}$$

where c [m/s] represents the speed of sound, ρ [$kg/m^3$] represents the density of air, f [kHz] represents a frequency, P[kPa] represents a pressure amplitude, S [μm] represents a displacement amplitude.

It can be understood from Equation (1) that the displacement amplitude of the ultrasound generator 80 has to be equal to or greater than 4.5 μm in the water in order to make acoustic pressure become equal to or greater than 600 kPa (under a frequency condition of 20 kHz).

If the frequency changes, acoustic pressure required to cause chaotic oscillation of bubbles may increase accordingly. This can be also verified from the graph of FIG. 19 showing the relationship between frequency and acoustic pressure, and the graph of FIG. 20 showing the relationship between frequency and displacement amplitude, which are ultrasound bubble maps.

FIG. 19 is a graph distinguishing a chaotic oscillation area enabling washing from a volume oscillation area disabling washing, according to frequency and acoustic pressure, with respect to Carbon Black requiring greatest mechanical power among soiled test fabrics.

Figure 20:
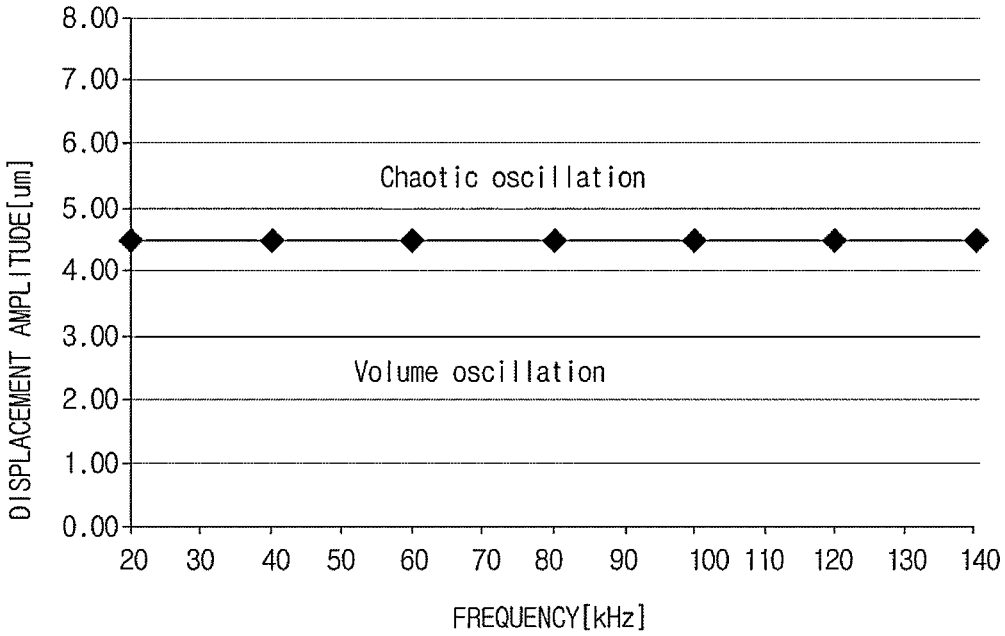

FIG. 20 is a graph distinguishing a chaotic oscillation area enabling washing from a volume oscillation area disabling washing, according to frequency and displacement amplitude in the water, with respect to Carbon Black requiring greatest mechanical power among soiled test fabrics.

In order to effectively wash soiled test fabrics Carbon Black requiring great mechanical power, controlling based on the chaotic oscillation areas of the ultrasound bubble maps as shown in FIGS. 19 and 20 is required. Referring to FIG. 20, in order to cause chaotic oscillation in the ultrasound bubble map, a constant displacement amplitude of 4.5 μm needs to be maintained. In order to maintain a constant displacement amplitude of 4.5 μm, it is necessary to increase acoustic pressure according to an increase of frequency. For example, when a frequency is 20 kHz, a displacement amplitude is 4.5 μm at acoustic pressure of 600 kPa, and when a frequency is 40 kHz, a displacement amplitude is 4.5 μm at acoustic pressure of 1200 kPa.

Figure 3:
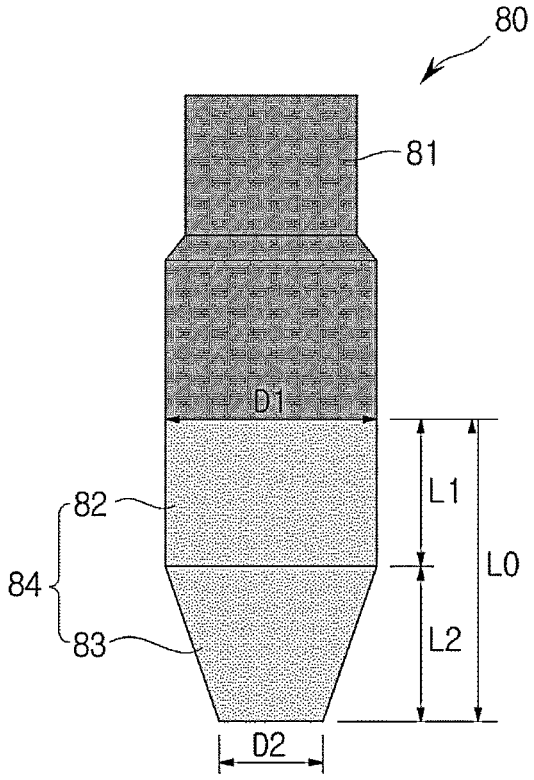
FIG. 3 illustrates an ultrasound generator according to an embodiment of the present disclosure.

In order to maintain a displacement amplitude of 4.5 μm or more regardless of frequency in the water, an ultrasound generator 80 configured by coupling an ultrasound transducer 81 with an ultrasound horn 84, as shown in FIG. 3, may be used to increase a displacement amplitude. At this time, the higher intensity is required at the higher frequency, and the lower intensity is required at the lower frequency.

FIG. 3 illustrates the ultrasound generator 80 according to an embodiment of the present disclosure.

As shown in FIG. 3, the ultrasound generator 80 may include the ultrasound transducer 81 to generate ultrasonic waves, and the ultrasound horn 84 coupled with the ultrasound transducer 81 to guide the ultrasonic waves generated by the ultrasound transducer 81 to the outside. The ultrasound generator 80 may be an ultrasound actuator.

The displacement amplitude of ultrasonic waves that are generated by the ultrasound generator 80 may be in an range of 4.5 μm to 22.5 μm in washing water. If a frequency of ultrasonic waves generated from the ultrasound generator 80 is 20 kHz, acoustic pressure of the ultrasonic waves may be in the range of 600 kPa to 3000 kPa. This considers chaotic oscillation of bubbles that are generated through ultrasound emission for washing soiled test fabrics.

Also, the ultrasound horn (L0) 84 may include a first element (L1) 82 that is coupled with the ultrasound transducer 81, and a second element (L2) 83 that is connected to the first element 82, wherein the diameter D1 of the first element 82 may be greater than the diameter D2 of the second element 83. The diameter D1 of the first element 82 is defined as the section diameter of the end contacting the ultrasound transducer 81, and the diameter D2 of the second element 83 is defined as the section diameter of the end from which ultrasonic waves are emitted to the outside.

Referring to FIG. 3, the ultrasound horn 84 to cause chaotic oscillation of ultrasound bubbles can satisfy a condition that a diameter ratio between the first element 82 and the second element 83 is 2:1 (D1:D2=2:1), and/or a condition that a length ratio between the first element 82 and the second element 83 in an emission direction of ultrasonic waves is 35:27 (L1:L2=35:27).

Figure 4:
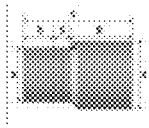
FIG. 4 shows configurations of ultrasound generators to which various shapes of ultrasonic horns are applied.
Figure 4:
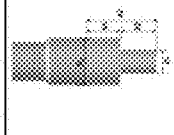
Figure 4:
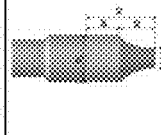
Figure 4:
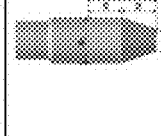
Figure 4:
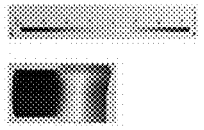
Figure 4:
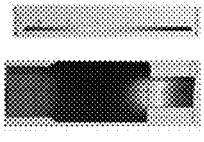
Figure 4:
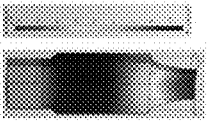
Figure 4:
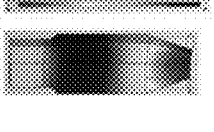

FIG. 4 shows configurations of ultrasound generators to which various shapes of ultrasonic horns are applied. Hereinafter, the results of analysis on displacement amplitudes of the ultrasound generators to which various shapes of ultrasonic horns are applied will be described as an example.

Referring to FIG. 4, as an example, the ultrasound horn 84 may have a step shape when it is shown from its longitudinal section. As another example, the second element 83 of the ultrasound horn 84 may have an inwardly concave shape (an exponential shape of FIG. 4). As still another example, the second element 83 of the ultrasound horn 84 may have a conical shape in which the circumference length of the end contracting the first element 82 is longer than that of the other end.

As shown in FIG. 4, in the air, a displacement amplitude of an ultrasound generator using only a general transducer is 12.1 μm, a displacement amplitude of an ultrasound generator in which an ultrasound transducer is coupled with a step-shaped ultrasound horn is 60.94 μm, a displacement amplitude of an ultrasound generator in which an ultrasound transducer is coupled with an exponential-shaped ultrasound horn is 31.24 μm, and a displacement amplitude of an ultrasound generator in which an ultrasound transducer is coupled with a conical ultrasound horn is 16.39 μm. Meanwhile, in the water, a displacement amplitude of the ultrasound generator using only the general transducer is 0.77 μm, a displacement amplitude of the ultrasound generator in which the ultrasound transducer is coupled with the step-shaped ultrasound horn is 2.42 μm, a displacement amplitude of the ultrasound generator in which the ultrasound transducer is coupled with the exponential-shaped ultrasound horn is 3.41 μm, and a displacement amplitude of the ultrasound generator in which the ultrasound transducer is coupled with the conical ultrasound horn is 4.73 μm. That is, a structure capable of more easily transferring ultrasonic energy generated by the ultrasound transducer 81 to the outside has a greater displacement amplitude value. In the air, the ultrasound generator in which the ultrasound transducer is coupled with the step-shaped ultrasound horn has the greatest displacement amplitude value, whereas in the water, the ultrasound generator in which the ultrasound transducer is coupled with the conical ultrasound horn has the greatest displacement amplitude value since load exists in the water.

FIGS. 5 to 9 show examples in which various types of ultrasound generators are applied to the washing machine 1 of FIG. 1.

Figure 5:
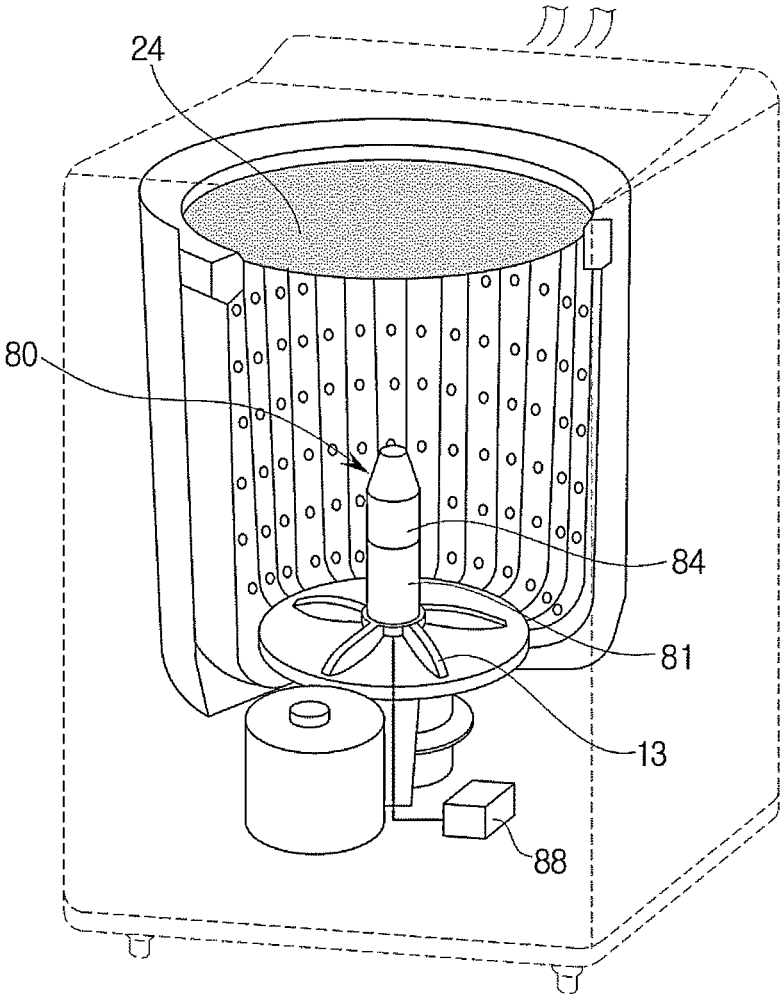
FIGS. 5 to 9 show examples in which various types of ultrasound generators are applied to the washing machine of FIG. 1.

As shown in FIG. 5, the ultrasound transducer 81 of the ultrasound generator 80 may be coupled with the pulsator 13. The ultrasound transducer 81 may be coupled with the central-axis part of the pulsator 13 so as to rotate together with the pulsator 13. However, it is also possible to rotate the pulsator 13 while fixing the ultrasound generator 80. If the ultrasound generator 80 rotates together with the pulsator 13, an effect of uniformly emitting ultrasonic energy in washing water can be obtained.

Figure 6:
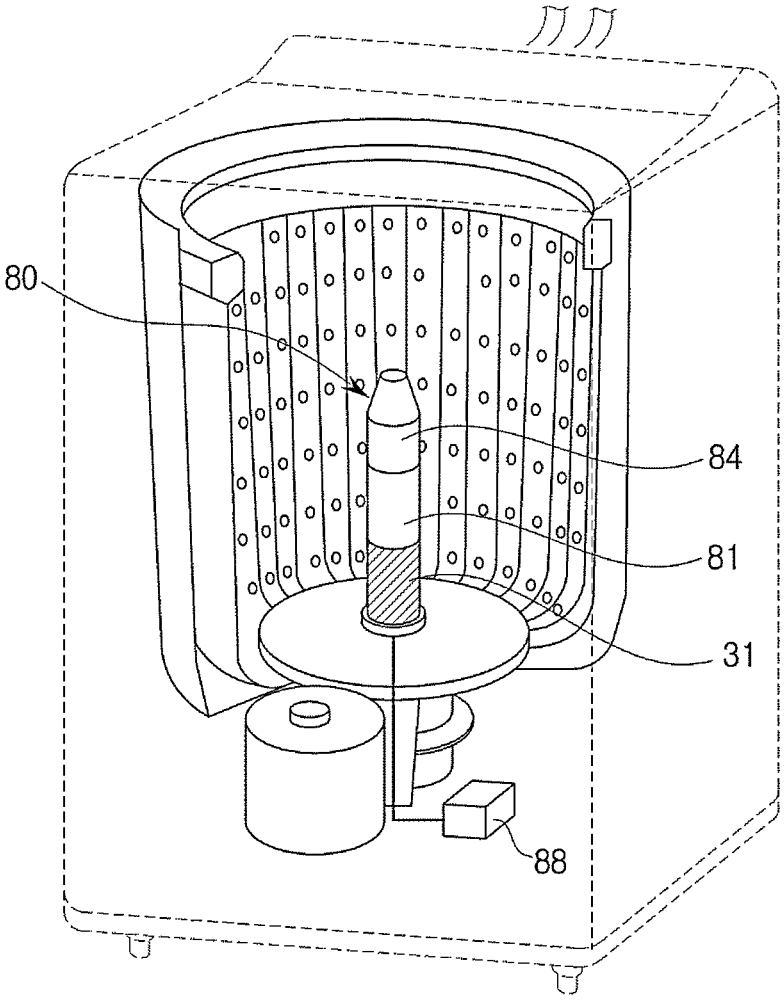

As shown in FIG. 6, the washing machine 1 may be an agitating type further including an agitator 31 that is installed in the drum 12 and rotates. In this case, the ultrasound transducer 81 of the ultrasound generator 80 may be coupled with the agitator 31. If the ultrasound generator 80 is coupled with the agitator 31, the ultrasound generator 80 acts to extend the vertical, axial length of the agitator 31 so that an effect of preventing entanglement of laundry during a washing process can be also obtained.

Figure 7:
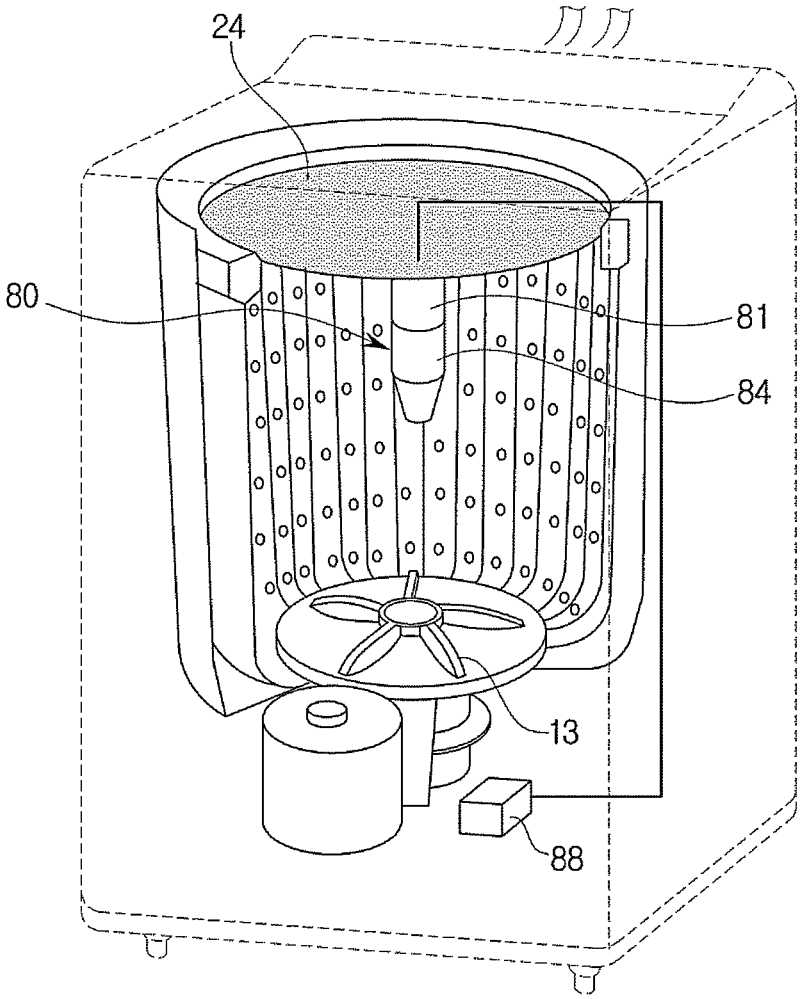

As shown in FIG. 7, the ultrasound transducer 81 of the ultrasound generator 80 may be coupled with the inner side of the door 24 for opening or closing the opening of the tub 11 such that the ultrasound horn 84 contacts washing water loaded in the drum 12.

Figure 8:
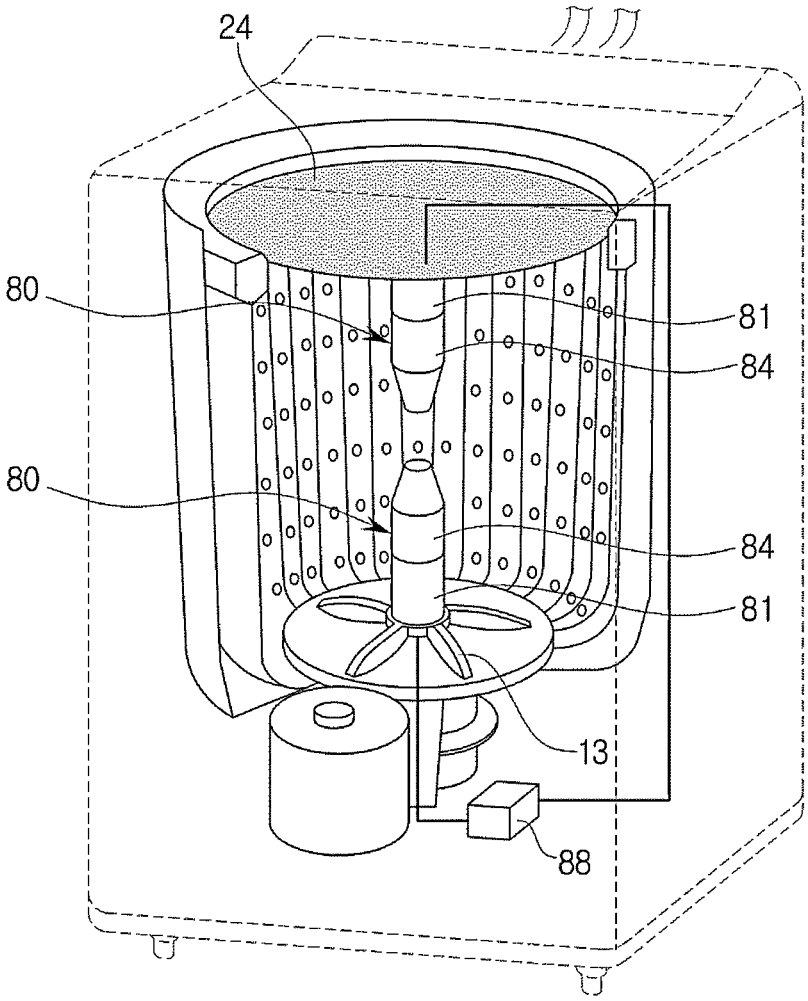

As shown in FIG. 8, a plurality of ultrasound generators 80 may be provided, and ultrasound transducers 81 of the ultrasound generators 80 may be respectively coupled with the pulsator 13 and the inner side of the door 24.

Figure 9:
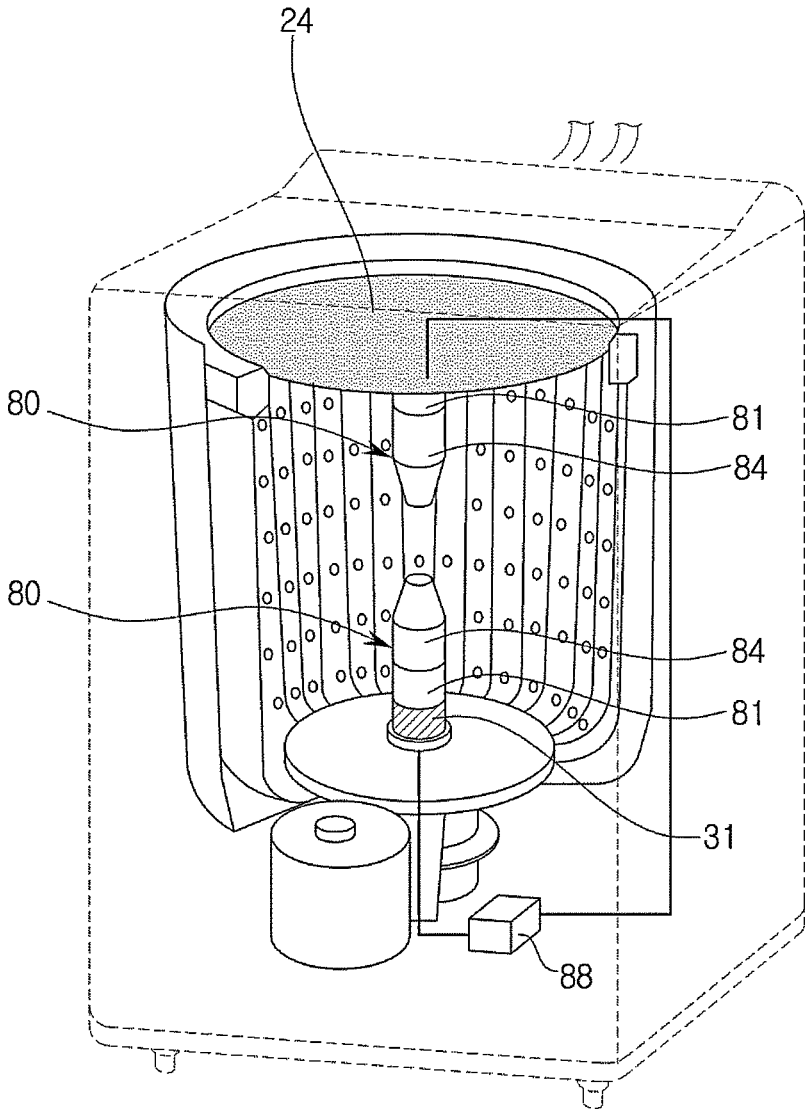

As shown in FIG. 9, a plurality of ultrasound generators 80 may be provided, and ultrasound transducers 81 of the ultrasound generators 80 may be respectively coupled with the upper part of the agitator 13 and the inner side of the door 24.

Figure 10:
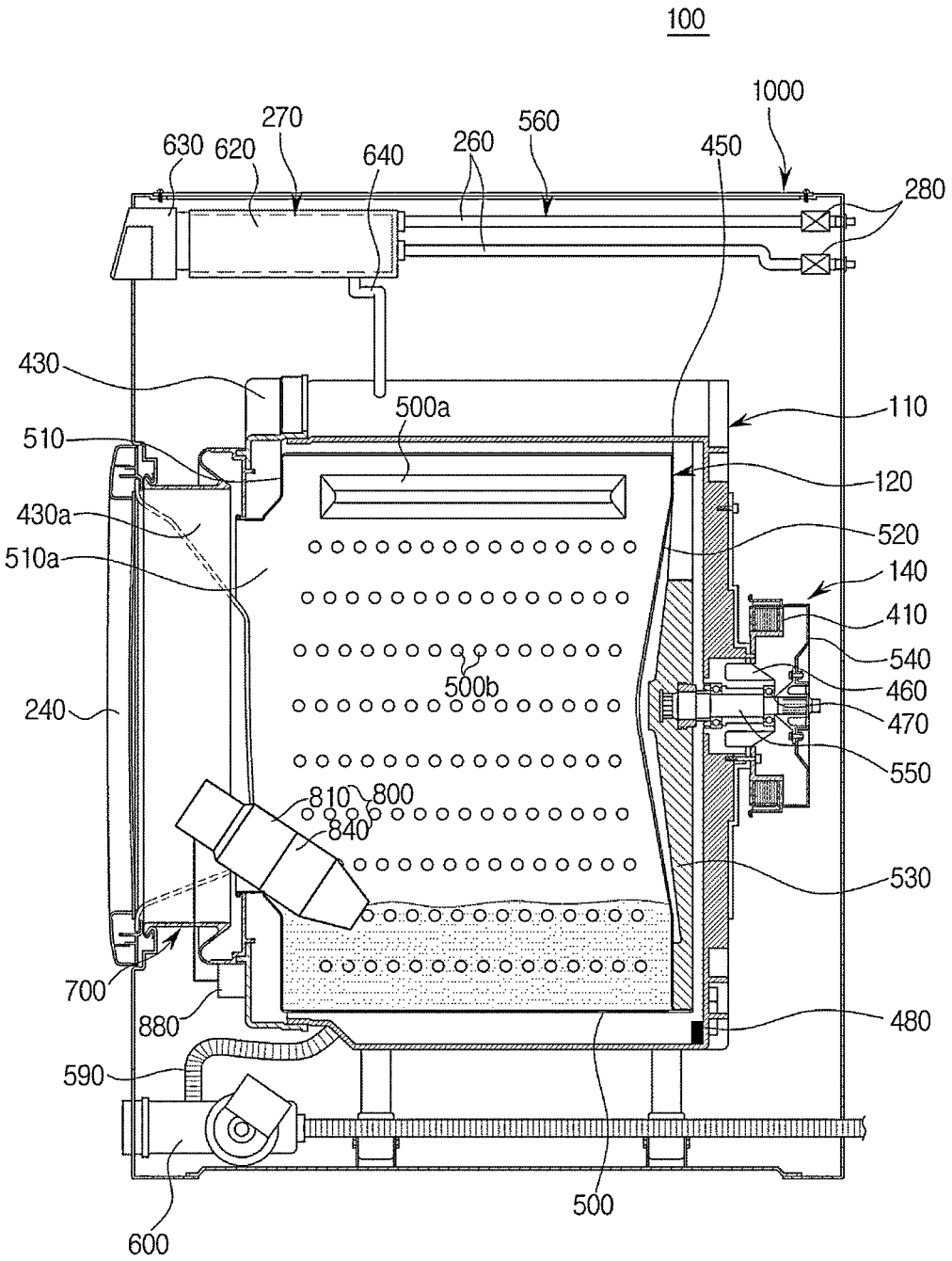
FIG. 10 shows an example in which an ultrasound generator is applied to the washing machine of FIG. 2.

FIG. 10 shows an example in which an ultrasound generator is applied to the washing machine 100 of FIG. 2. The washing machine 1 shown in FIG. 10 may be a drum type washing machine.

As shown in FIG. 10, the ultrasound generator 800 may be coupled with the diaphragm 700 such that the ultrasound horn 840 contacts washing water loaded in the drum 120. The ultrasound generator 800 may be coupled with the lower part of the diaphragm 700 with respect to the vertical axis of the washing machine 100 so that the ultrasound horn 840 contacts washing water during a washing process, and emits ultrasonic waves to form bubbles.

Figure 11A:
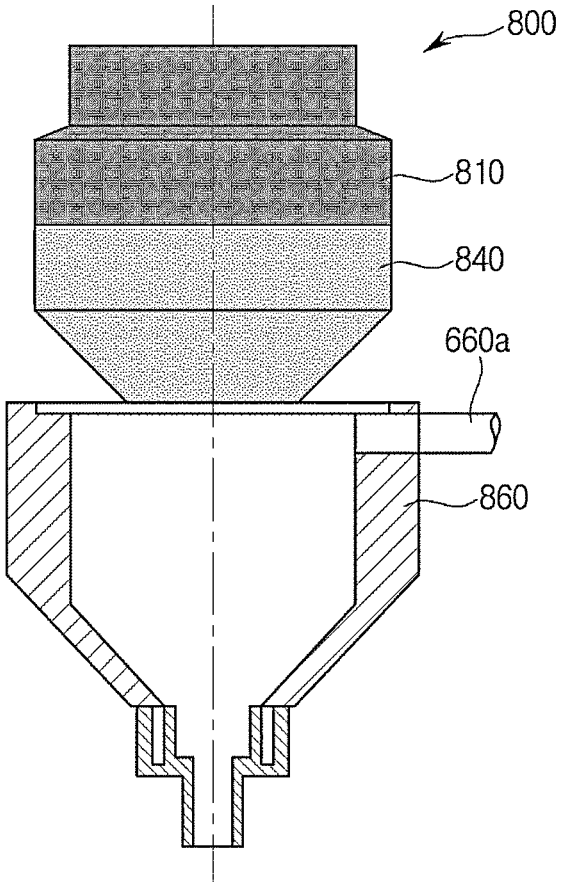
Figure 11B:
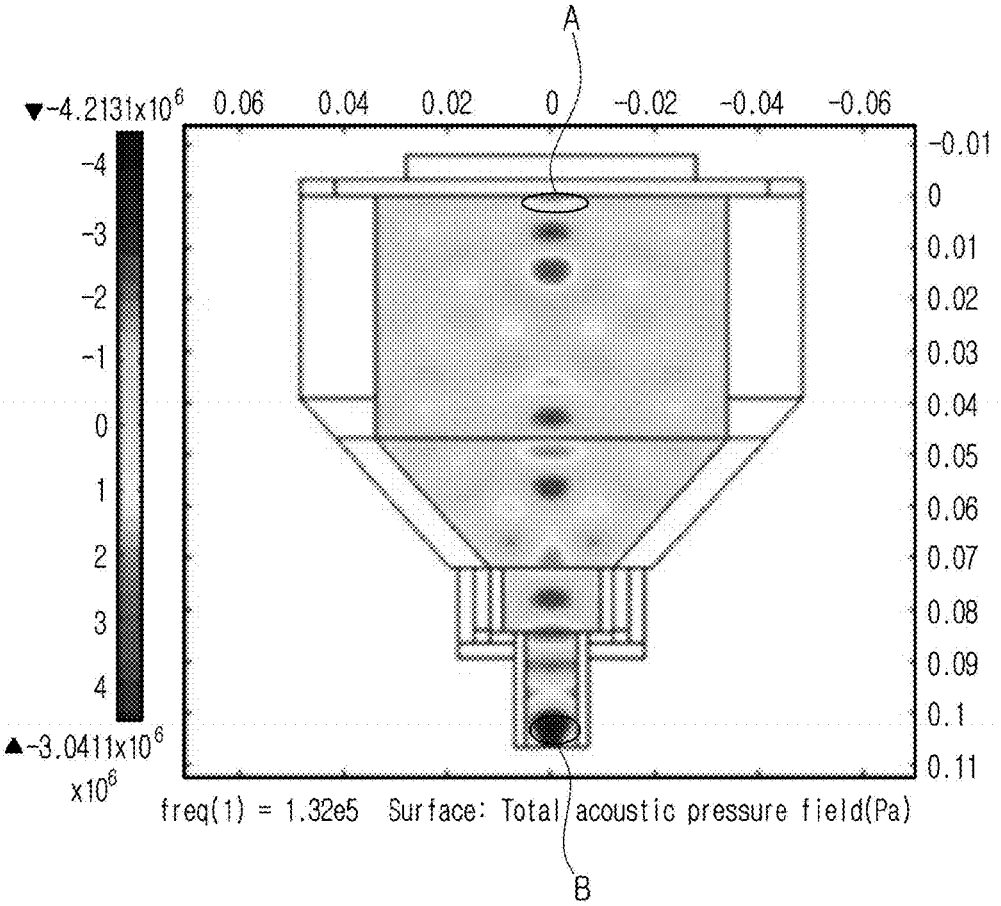
Figure 12:
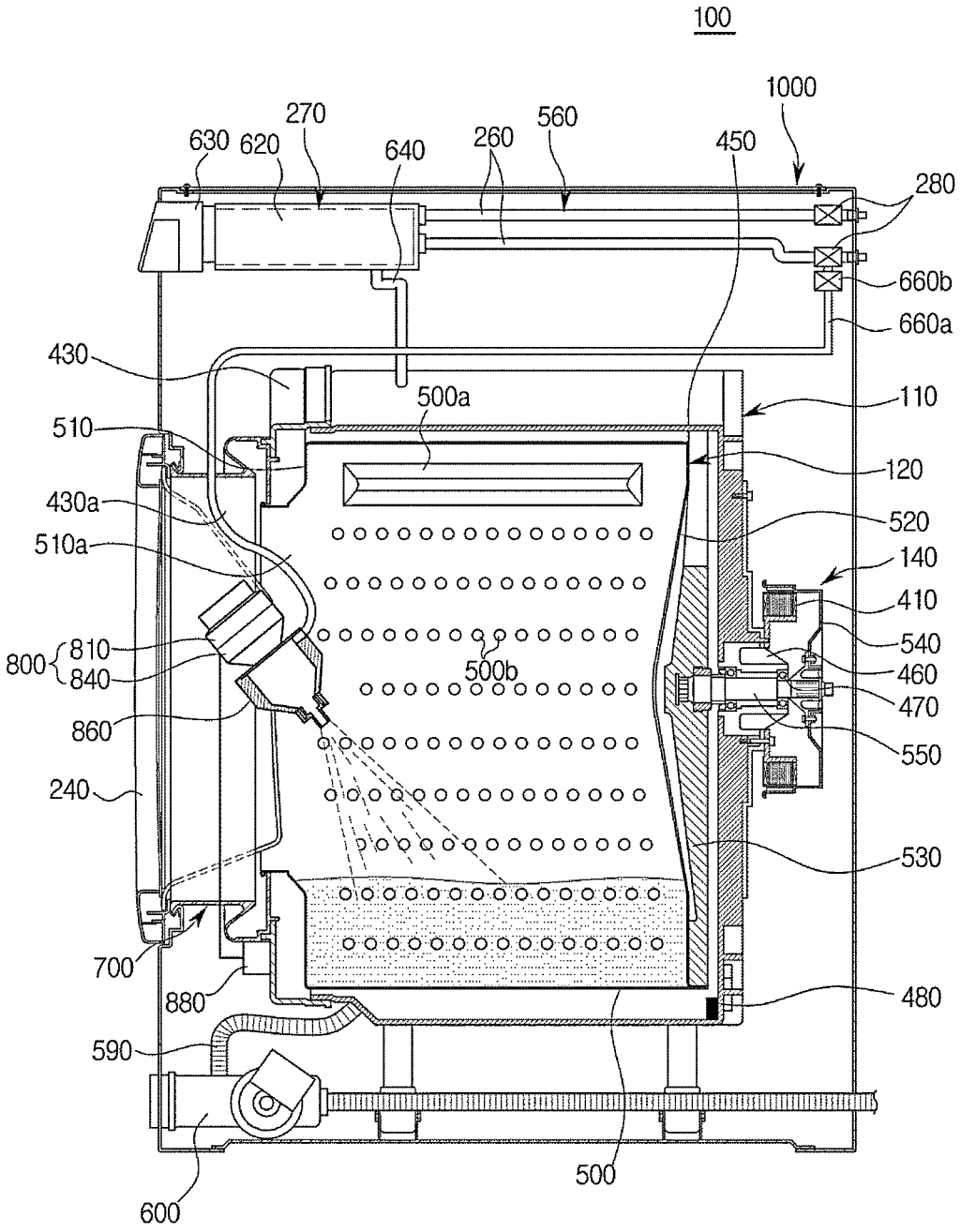
FIG. 12 shows an example in which the ultrasound generator of FIG. 11 is applied to the washing machine of FIG. 2.
Figure 13:
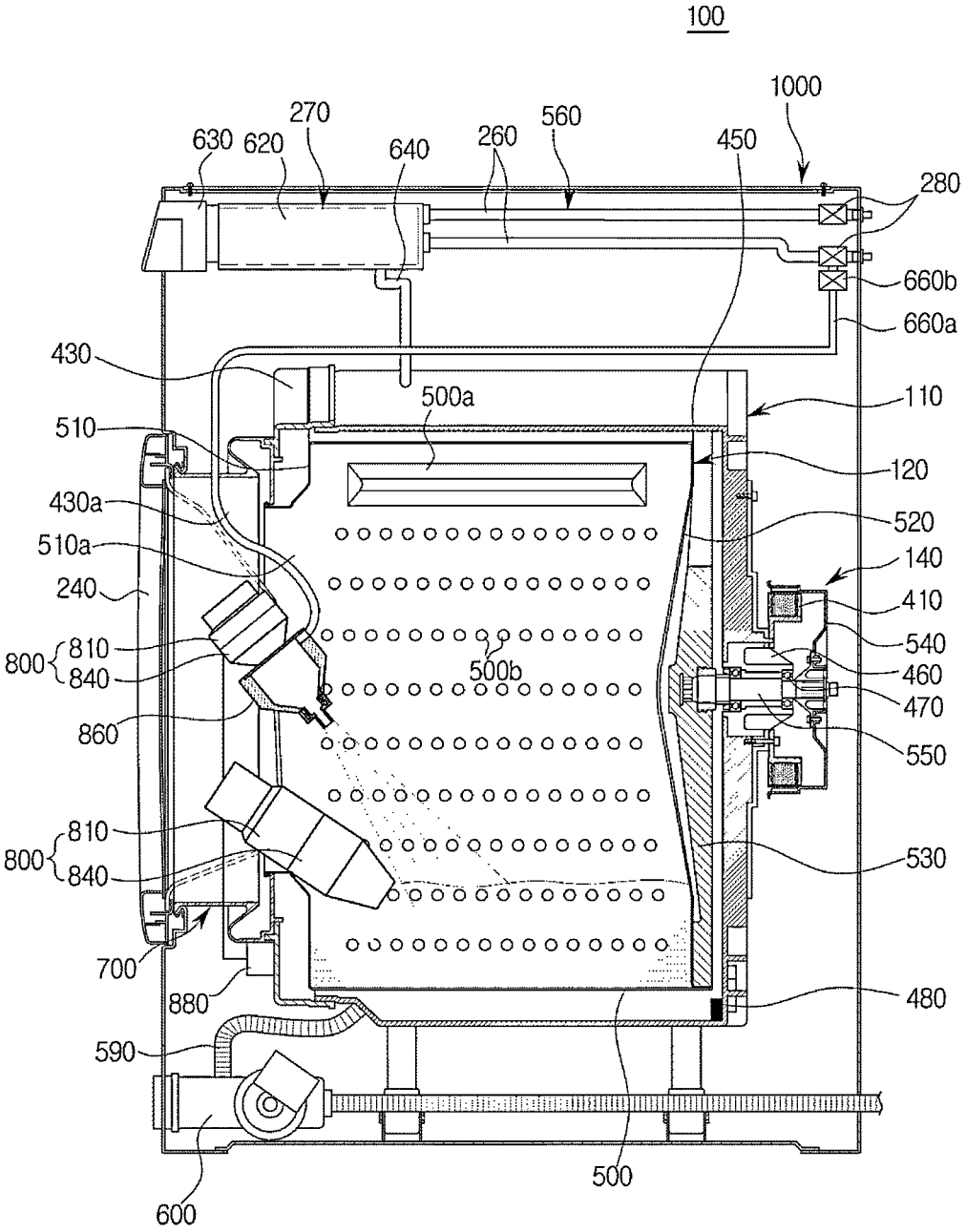
FIG. 13 shows an example in which the ultrasound generator of FIG. 3 and the ultrasound generator of FIG. 11 are applied to the washing machine of FIG. 2.

FIGS. 11A, 11B, and 110 are views for describing an ultrasound generator according to another embodiment of the present disclosure, FIG. 12 shows an example in which the ultrasound generator of FIG. 11A is applied to the washing machine 100 of FIG. 2, and FIG. 13 shows an example in which the ultrasound generator of FIG. 3 and the ultrasound generator of FIG. 11A are applied to the washing machine 100 of FIG. 2.

As shown in FIG. 11A, the ultrasound generator 800 may include an ultrasound transducer 810 to generate ultrasonic waves, an ultrasound horn 840 coupled with the ultrasound transducer 810 and configured to guide ultrasonic waves generated by the ultrasound transducer 810 to the outside, and a nozzle 860 coupled with the ultrasound horn 840 and configured to emit ultrasonic waves together with water.

The nozzle 860 may be coupled with a washing water supply pipe 660*a* to supply washing water. As shown in FIG. 12, the washing water supply pipe 660*a* may be connected to an external water supply source (not shown), and the washing water supply pipe 660*a* includes a washing water supply valve 660*b* to open and close the washing water supply pipe 660*a*. The washing water supply valve 660*b* may be connected to a water supply valve 280.

FIG. 11B shows the results of analysis on an acoustic pressure distribution in the nozzle 860. As shown in FIG. 11B, the ultrasound generator 800 including the nozzle 860 allowing a water jet can increase acoustic pressure by about 80% since an acoustic pressure value of an A area to which washing water is fed from the nozzle 860 is 2.5, and an acoustic pressure value of a B area from which the washing water is discharged is −4.5. Since the ultrasound generator 800 including the nozzle 860 can increase acoustic pressure or intensity by about 80% or more, an effect of reducing energy consumption under the same acoustic pressure condition can be also obtained.

Figure 11C:
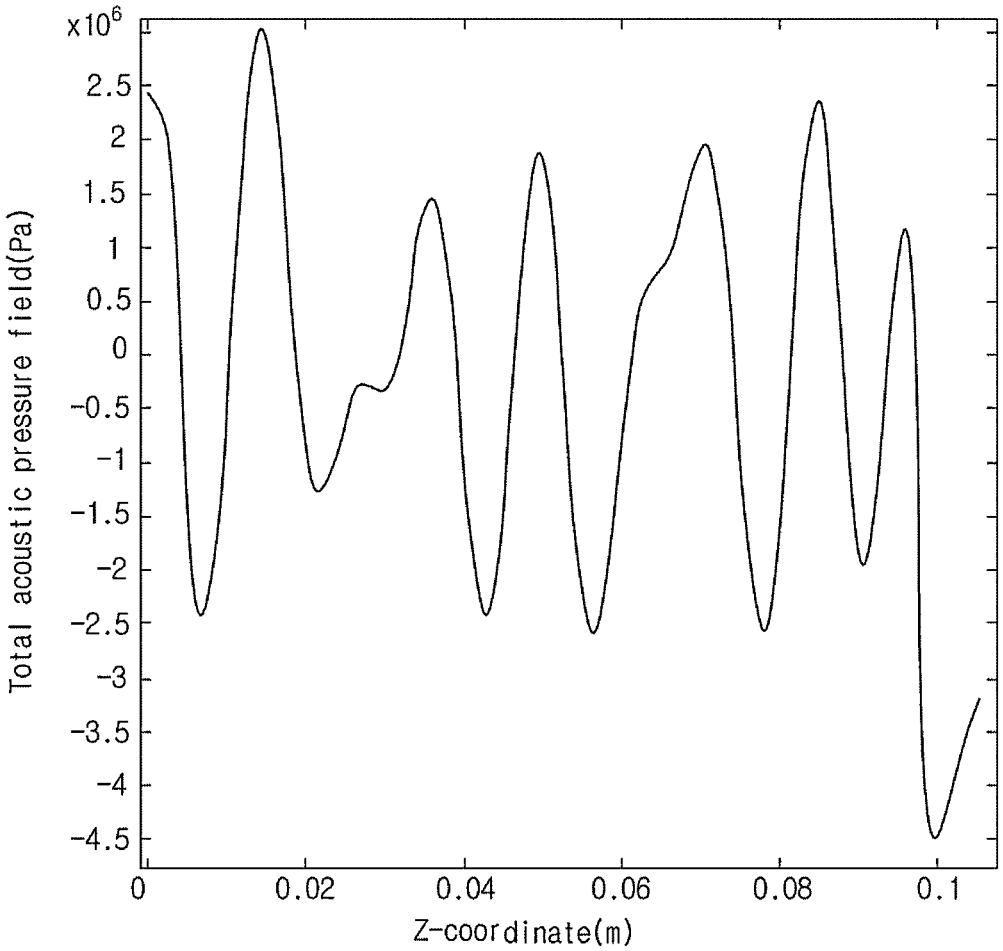

FIG. 11C is a graph showing a total acoustic pressure field in the nozzle 860, wherein the z-coordinate 0 is an entrance of the nozzle 860, and the z-coordinate 0.1 represents an outlet of the nozzle 860. In the nozzle 860 of FIG. 11A, since the outlet of the nozzle 860 from which washing water is discharged has a narrower diameter than that of the entrance of the nozzle 860 to which washing water is supplied, acoustic pressure +2.5 at the entrance of the nozzle increases to −4.5 at the outlet of the nozzle 860, that is, an increase rate of acoustic pressure is 1.8 (4.5/2.5=1.8, signs of + and − are ignored). In other words, acoustic pressure at the outlet of the nozzle 860 increases by about 80% rather than acoustic pressure at the entrance of the nozzle 860.

As shown in FIG. 12, the ultrasound generator 800 to which the nozzle 860 is connected may be coupled with the diaphragm 700. The ultrasound generator 800 may be coupled with the upper part of the diaphragm 700 with respect to the vertical axis of the diaphragm 700. Since the ultrasound generator 800 to which the nozzle 860 is connected can emit ultrasonic energy together with washing water through a water jet of jetting water through the nozzle 860, the ultrasound generator 800 may be spaced away from washing water. Thereby, freedom of design of the ultrasound generator 800 in the washing machine 100 can be improved.

As shown in FIG. 13, there may be provided an ultrasound generator 800 that contacts washing water, and another ultrasound generator 800 that is spaced away from the ultrasound generator 800 contacting the washing water and that is connected to the nozzle 860 to emit ultrasonic waves and water.

Figure 14:
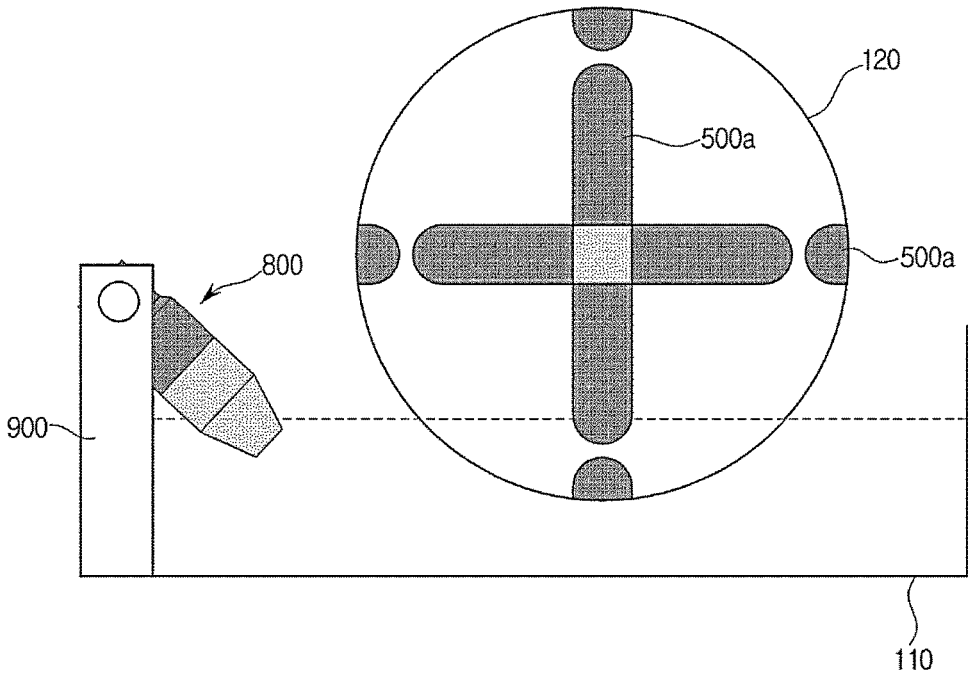
FIG. 14 shows another example in which an ultrasound generator is applied to the washing machine of FIG. 2.

FIG. 14 shows another example in which the ultrasound generator 800 is applied to the washing machine 100 of FIG. 2.

As shown in FIG. 14, the ultrasound generator 800 may be disposed between the tub 110 and the drum 120 so as to transfer ultrasonic waves into the drum 120 through the through-holes (500*b* of FIG. 2) formed in the drum 120.

The washing machine 100 may further include a support unit 900 having a shape capable of supporting the ultrasound generator 800, and configured to adjust an incident angle of ultrasonic waves that are generated by the ultrasound generator 800.

The lifter 500*a* provided on the inner surface of the drum 120, and configured to lift laundry may be formed as a cross-shaped protrusion on the rear part of the drum 120, or as straight lined protrusions on the entire cylindrical wall of the drum 120. The lifter 500*a* may swirl washing water while raising and dropping laundry to mix the laundry, when the drum 120 rotates, thereby allowing the ultrasound generator 800 to uniformly apply ultrasonic waves to the laundry, and increasing a friction force between the laundry to improve washing efficiency.

Figure 21:
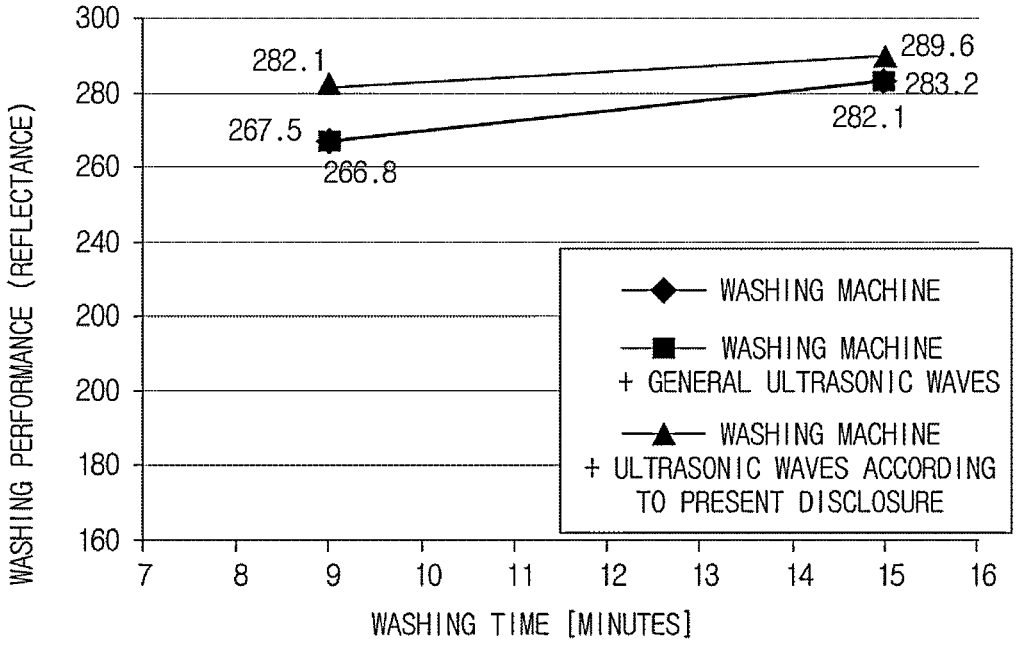
FIG. 21 is a graph showing a washing effect of a washing machine according to an embodiment of the present disclosure.

FIG. 21 is a graph showing a washing effect of the washing machine 1 according to an embodiment of the present disclosure.

FIG. 21 shows the comparison results of washing performance according to washing times with respect to a general washing machine, a washing machine to which ultrasonic waves are generally applied, and a washing machine to which ultrasonic waves are applied according to the present disclosure. In FIG. 21, washing performance is expressed as a sum of reflectance of artificially soiled test fabrics EMPA 108, and the greater sum of reflectance, the more excellent washing performance.

As shown in FIG. 21, when a washing process was performed for 9 minutes, the washing performance of the washing machine to which ultrasonic waves are applied according to the present disclosure was improved by reflectance of 15.3, rather than those of the washing machine to which no ultrasound technique is applied and the washing machine to which a general ultrasound technique is applied. Also, when a washing process was performed for 15 minutes, the washing performance of the washing machine to which ultrasonic waves is applied according to the present disclosure was improved by reflectance of 7.5 rather than those of the other washing machines. Based on the comparison results, it can be verified that the washing machine to which the ultrasound generator according to the present disclosure is applied can obtain the same washing performance as the conventional washing machines even when a washing time is reduced from 15 minutes to 9 minutes. That is, the washing machine to which the ultrasound generator according to the present disclosure is applied can obtain an effect of reducing a washing time while maintaining washing performance.

Therefore, since the washing machine according to the embodiment of the present disclosure includes the ultrasound generator in which the ultrasound horn is coupled with the ultrasound transducer to increase a displacement amplitude of the ultrasound generator and cause chaotic oscillation of bubbles, washing performance can be improved.

Also, the washing machine can effectively wash soiled test fabrics such as Carbon Black requiring great mechanical energy, while reducing a washing time.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a tub;

a drum rotatably disposed inside the tub;

an agitator having a cylindrical shape, disposed in the drum, and configured to rotate about a central axis of the cylindrical shape; and an ultrasound generator having a cylindrical shape with a lower part coupled at a connection point with an upper part of the agitator to extend a vertical and axial length of the agitator along the central axis, and configured to emit ultrasonic waves to washing water loaded in the drum, to generate bubbles in the washing water, wherein an exterior circumference of the lower part of the ultrasound generator at the connection point is substantially flush with an exterior circumference of the upper part of the agitator at the connection point to provide a smooth transition from the ultrasound generator to the agitator to prevent an entanglement of laundry at the connection point.

2. The washing machine according to claim 1, wherein the ultrasonic generator is configured to emit the ultrasonic waves such that the ultrasonic waves have a combination of a displacement amplitude, an ultrasonic wave frequency, and an acoustic pressure sufficient to cause chaotic oscillation of the bubbles.

3. The washing machine according to claim 2, wherein the ultrasonic generator is configured to emit the ultrasonic waves such that the ultrasonic waves have both a frequency of 20 kHz and an acoustic pressure in a range of 600 kPa to 3000 kPa.

4. The washing machine according to claim 1, further comprising an additional ultrasound generator, wherein the additional ultrasound generator comprises:

an ultrasound transducer configured to generate ultrasonic waves, and an ultrasound horn coupled with the ultrasound transducer and configured to guide the ultrasonic waves generated by the ultrasound transducer to the outside.

5. The washing machine according to claim 1, further comprising an additional ultrasound generator.

6. The washing machine according to claim 1, further comprising an additional ultrasound generator and a door disposed to cover an opening of the tub, wherein the additional ultrasound generator is coupled with an inner side of the door.

7. The washing machine according to claim 1, further comprising:

a door disposed to cover an opening of the tub, wherein the ultrasound generator is among a plurality of ultrasound generators included in the washing machine, and at least one of the plurality of ultrasound generators is coupled with an inner side of the door.

8. The washing machine according to claim 1, further comprising:

an additional ultrasound generator;

a door; and a nozzle configured to jet water into the drum, wherein a first end of the additional ultrasound generator is coupled with a first end of the nozzle to apply acoustic pressure of ultrasonic waves to water jetted into the drum.

9. The washing machine according to claim 1, further comprising:

an additional ultrasound generator, wherein the drum comprises one or more through-holes, and the additional ultrasound generator is disposed between the tub and the drum, and transfers ultrasonic waves into the drum through the through-holes.

10. The washing machine according to claim 9, wherein the tub further comprises a support unit having a shape configured to the additional ultrasound generator, and configured to adjust an incident angle of ultrasonic waves that are generated by the additional ultrasound generator.

11. The washing machine according to claim 1, further comprising:

an additional ultrasound generator, wherein the additional ultrasound generator comprises:

an ultrasound transducer configured to generate ultrasonic waves, and an ultrasound horn coupled with the ultrasound transducer and configured to guide the ultrasonic waves generated by the ultrasound transducer to the outside, the ultrasound horn comprises a first element coupled with the ultrasonic transducer, and a second element connected to the first element, and a diameter of the first element is longer than a diameter of the second element.

12. The washing machine according to claim 11, wherein a diameter ratio of a diameter of the first element to a diameter of the second element is 2:1.

13. The washing machine according to claim 11, wherein a length ratio of a length of the first element to a length of the second element in an emission direction of ultrasonic waves is 35:27.

14. The washing machine according to claim 11, wherein a longitudinal section of the ultrasound horn has a step shape.

15. The washing machine according to claim 11, wherein the second element of the ultrasound horn has an inwardly concave shape.

16. The washing machine according to claim 11, wherein the second element of the ultrasound horn has a conical shape.

17. The washing machine according to claim 1, further comprising:

an additional ultrasound generator;

a door;

a water supply pipe; and a nozzle having an opening on a first end of the nozzle, a second end opposite to the first end, and a side wall around the central axis of the nozzle, the central axis passing from the first end to the second end, wherein the water supply pipe supplies water into nozzle through the side wall, the nozzle is configured to receive water from the water supply pipe and jet the received water into the drum through the opening, and a first end of the additional ultrasound generator is coupled with the second end of the nozzle to apply acoustic pressure of ultrasonic waves to water jetted into the drum.

* * * * *